United States Patent [19]

Bayley

[11] 4,148,741

[45] Apr. 10, 1979

[54] POLYMERIZATION AND ATTRITION METHOD FOR PRODUCING TONER WITH REDUCED PROCESSING STEPS

[75] Inventor: Robert D. Bayley, Ontario, N.Y.

[73] Assignee: Xerox Corporation, Stamford, Conn.

[21] Appl. No.: 711,005

[22] Filed: Aug. 2, 1976

[51] Int. Cl.[2] ..... G03G 9/08

[52] U.S. Cl. ..... 252/62.1 P; 252/62.1 R; 260/42.14; 260/42.15; 260/47.53; 427/218; 427/219; 427/221

[58] Field of Search ..... 252/62.1 P, 62.1 R; 427/221, 218, 219; 260/42.14, 42.15, 42.53; 264/126

[56] References Cited

U.S. PATENT DOCUMENTS

| | | | |
|---|---|---|---|
| 2,751,369 | 6/1956 | Grotenhuis | 260/42.15 |
| 3,290,165 | 12/1966 | Iannicelli | 260/42.15 |
| 3,634,251 | 1/1972 | Maeda et al. | 252/62.1 P |
| 3,674,736 | 7/1972 | Lerman et al. | 252/62.1 P |
| 3,745,118 | 7/1973 | Brynko | 252/62.1 P |
| 3,840,464 | 10/1974 | Van Engeland et al. | 252/62.1 P |
| 3,959,153 | 5/1976 | Sadamatsu et al. | 252/62.1 P |
| 3,960,737 | 6/1976 | Kawanishi | 252/62.1 P |
| 3,975,481 | 8/1976 | Baumgaertner | 264/126 |
| 4,077,804 | 3/1978 | Vanzo | 252/62.1 P |

FOREIGN PATENT DOCUMENTS

| | | | |
|---|---|---|---|
| 1025694 | 1966 | United Kingdom | 427/221 |

*Primary Examiner*—John D. Smith

[57] ABSTRACT

A method of toner formation utilizing bead polymerization to produce colored particles which may be directly attrited to toner.

21 Claims, No Drawings

POLYMERIZATION AND ATTRITION METHOD FOR PRODUCING TONER WITH REDUCED PROCESSING STEPS

BACKGROUND OF THE INVENTION

This invention relates to electrophotography and more particularly to improved electrostatographic developing materials, their manufacture and use.

The formation and development of images on the surface of photoconductor materials by electrostatic means is well known. The basic xerographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting latent electrostatic image by depositing on the image a finely-divided electroscopic material referred to in the art as "toner". The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic particles to the latent electrostatic image to be developed. One development method, as disclosed by E. N. Wise in U.S. Pat. No. 2,618,552, is known as "cascade" development. In this method, a developer material comprising relatively large carrier particles having finely-divided toner particles electrostatically coated thereon is conveyed to and rolled or cascaded across the electrostatic latent image bearing surface. The composition of the carrier particles is so selected as to triboelectrically charge the toner particles to the desired polarity. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier and excess toner are then recycled. This technique is extremely good for the development of line copy images.

Another method of developing electrostatic images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method, a developer material comprising electrically charged toner particles in a gaseous fluid is passed adjacent the surface bearing the latent electrostatic image. The toner particles are drawn by electrostatic attraction from the gas to the latent image. This process is particularly useful in continuous tone development.

Other development methods such as "touchdown" development, as disclosed by R. W. Gundlach in U.S. Pat. No. 3,166,432, may be used where suitable.

Toners have generally been prepared by thoroughly mixing the softened resin and pigment to form a uniform dispersion as by blending these ingredients in a rubber mill or the like and then pulverizing this material to form it into small particles. Most frequently, this division of the resin pigment dispersion has been made by jet pulverization of the material. Although this technique of toner manufacture has produced some very excellent toners, it does tend to have certain shortcomings. For example, it generally produces a rather wide range of particle sizes in the toner particles. Although the average particle size of toner made according to this technique generally ranges between about 5 and about 10 microns, individual particles ranging from sub micron in size to above 20 microns are not infrequently produced. Furthermore, this is a batch process which tends to be slow, expensive, noisy and dusty. In addition, this technique of toner production imposes certain limitations upon the material selected for the toner because the resin-pigment dispersion must be sufficiently friable so that it can be pulverized at an economically feasible rate of production. The problem which arises from this requirement is that when the resin-pigment dispersion is sufficiently friable for really high speed pulverizing, it tends to form an even wider range of particle sizes during pulverization including relatively large percentages of fines. In addition, such highly friable materials are frequently subject to further pulverization or powdering when they are employed for developing in xerographic copying apparatus. All other requirements of xerographic developers or toners including the requirements that they be stable in storage, nonagglomerative, have the proper triboelectric properties for developing, form good images, do not film or soil the selenium xerographic plate and have a low melting point for heat fusing are only compounded by the additional requirements imposed by this toner forming process.

Another method of toner formation consists of blending a water latex of the desired toner resin with a colorant and then spray drying this combined system to the desired particle size. The spray drying step consists of atomizing the colorant-water latex blend into small droplets, mixing these with a gas, and holding the droplets in suspension in the gas until evaporation drives off the liquid in the droplets and heat and surface tension forces cause the resin particles in each droplet to coalesce encasing the colorant included in that droplet. Most frequently, spray drying utilizes air as the gas for the drying step. The gas is heated to raise the temperature of the resin particles to a point where they coalesce so that the many small particles originating in any one droplet formed during atomization come together to form a small, hard spherical toner particle which entraps any colorant initially included within the droplet.

The colorant used may be either water soluble in which case it may be merely added and dissolved into the resin latex or water insoluble dye in which case it may first be placed in an aqueous suspension and then added to the resin latex. Spray dried toners are not totally satisfactory as it is difficult to completely remove all the solvent and the solvent which remains in the toner particles acts to effect triboelectric properties and contribute to blocking of the toner when in use.

In U.S. Pat. No. 3,391,082 to Maclay, it is proposed that toner be formed directly from an emulsion polymerization system. However, this method is not totally satisfactory as the toner comprises agglomerates of the small latex (0.03 to 0.25 micron) particles the total drying of the system is difficult leading to blocking problems and also voids in the particles may cause structural weakness and uneven triboelectric properties.

It has been proposed in United Kingdom Patent 1,319,815 that toner be prepared directly from the monomer by polymerization of the monomer in toner sized particles containing a colorant. The method of the British patent comprises preparing a kneaded oil phase component made up of one or more liquid resin monomers, coloring material, the polymerization initiator and a finely-divided inorganic dispersion stabilizer such as a metal powder or inorganic salt or oxide and a polar resinous additive which is soluble in a monomer. After suspension polymerization of the monomer, if required, the finely-divided dispersion stabilizer is removed by dissolution in an acid and the polymer particles are removed from the aqueous phase and dried to produce toner. However, this process is not totally successful as it requires a high ratio of inorganic stabilizer which needs to be removed or it affects the quality of the toner. Further the particles recovered contain an unacceptably great number of particles which are either larger or smaller than the size range preferred for electrophotographic use. Further, the removal of the inorganic stabilizer adds a process step thereby minimizing the advantage of forming a toner in one operation from the monomer. The process in any case often results in incomplete polymerization that leaves residual monomer that affects the triboelectric, blocking and fixing properties of the toner. This incomplete polymerization of the monomer is theorized as caused by the pigment inhibiting polymerization. The similar type Maeda et al process, U.S. Pat. No. 3,634,251, also entails the removal of the inorganic component and problems of incomplete polymerization.

It has also been proposed that a suspension polymerization process similar to the above referenced British patent but not making use of an inorganic stabilizer be carried out to produce an encapsulated toner. This process is performed generally be mixing a monomer, a colorant and an initiator to form an oil soluble organic phase; dispersing this oil soluble phase in controlled size between 5 to 20 microns in a water phase, employing a suspending agent, for example polyvinyl alcohol; polymerizing, employing conventional suspension polymerization techniques; introducing a second monomer which is allowed to diffuse into the first polymer and consequently swells the polymer; introducing a water soluble initiator; and heating this reaction mixture to effect a polymerization of the second monomer and form the desired toner. It is found that the second initiator, the water soluble initiator, generates a free radical which attacks the surface of the swollen polymer particle and promotes polymerization at the surface by reacting with monomer at the surface thereby decreasing the monomer concentration and causing the transport of monomer to the surface by diffusion. The process is found to be self terminating when the total amount of sorbed monomer has been converted to polymer at the surface, thus providing an encapsulated toner. However, while this process may be used to produce encapsulated toners, it still does not provide an acceptable method for producing toners which are not encapsulated and which may withstand the abrasion, stress and humidity variation to which toners are subject in ordinary development systems.

In formation of toner by known processes such as emulsion polymerization, spray drying or attrition from bulk, the problem of elements on the surface of the particle acting in a hydrophilic manner remains. Elements such as exposed pigment reactive groups, solvent or reactive monomers may attract water molecules and contribute to blocking of the toner and changes in triboelectric properties.

As can be seen, there remains a need for a process of producing toners which would not involve extensive processing steps of polymer formation, colorant addition, mixing and particle formation. There remains a need for a process which would produce toners that have good triboelectric properties, abrasive resistance, blocking resistance, narrow size variation, and good colorant loading capability. Since the prior forming methods are deficient in one or more of the above areas, there is a continuing need for an improved method of formation of toners for use in electrophotographic development.

SUMMARY OF THE INVENTION

It is therefore an object of this invention to provide a toner overcoming the above noted deficiencies.

It is another object of this invention to provide a method of producing a toner which overcomes the above noted deficiencies in processes of toner production.

It is still another object of this invention to provide a toner of high resistance to blocking.

It is a further object of this invention to provide a method of direct polymerization of polymers to form particles suitable for attrition to colored toners.

It is a further object of this invention to provide a low cost method for toner production.

It is a still further object of this invention to provide a process of minimizing the humidity sensitivity of toner.

It is still a further object of this invention to provide a method of toner formation utilizing fewer steps than present processes.

It is an additional object of the invention to allow the use of less carbon in a toner particle.

It is an additional object to produce a developer that gives clear high quality images.

It is a further object to produce toner that forms clear sharp images.

These and other objects of the instant invention are accomplished, generally, by providing a process for dispersing in aqueous medium a monomer having dispersed therein a pigment. The pigmented monomer is formed to droplets of the particle size of between about 200 microns and about 600 microns. Such particles are agitated in a reactor during polymerization to form polymerized beads. Then after separation of the suspension polymerized beads from the water, the beads are attrited to produce toner particles. These particles may be combined with suitable carriers to produce developers for electrostatic latent images. The toner particles have an irregular surface.

DETAILED DESCRIPTION OF THE INVENTION

The toner formation process of the invention is carried out in one instance by the use of a styrene monomer to which is added lauroyl peroxide and Molacco-H carbon black that has been treated with an active silane dispersion agent such as triethoxy silane. The carbon particles are coated with the silane by suspension of the carbon in water followed by addition of the triethoxy silane ("Siliclad", Clay Adams Division of Becton Dickinson Co.). The mixture of silane and carbon is agitated to allow the silane to form a coat on the surface of the carbon particles comprising precipitated silanes and silanes reacted with surface groups of pigment. The treated (cladded) carbon is dispersed in a styrene monomer with lauroyl peroxide. Then, utilizing conventional suspension polymerization equipment, the monomer, containing pigment, is suspended in an aqueous medium and particles are formed. The suspension of pigmented monomer is then polymerized in a reactor which is agitated by a stirrer at about 75 r.p.m. as polymerization takes place. After polymerization is complete, the particles are separated from the suspension, dried, and jetted to form toner particles.

Any polymeric material which may be formed by dispersion polymerization and which has a melting point within the range suitable for use as a toner may be used in the toner forming process of the instant invention. Typical monomeric units which may be employed to form polymers include: styrene, p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropanyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof. Generally, suitable vinyl resins employed in the toner have a weight average molecular weight between about 3,000 to about 500,000.

Toner resins containing a relatively high percentage of sytrene resins are typically preferred. The presence of a styrene resin is preferred because a greater degree of image definition is achieved with a given quantity of additive material. Further, denser images are obtained when at least about 25 percent by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Thus, typical monomeric materials which may be copolymerized with styrene by addition polymerization include: p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof. The styrene resins may also be formed by the polymerization of mixtures of two or more of these unsaturated monomeric materials with a styrene monomer. The expression "addition polymerization" is intended to include known polymerization techniques, such as radicals, anionic and cationic polymerization processes. Monomers forming polystyrene and copolymers of styrene and n-butylmethylacrylate have been found to be particularly suitable for the polymerization process of the invention as they result in good yields of completely polymerized monomer which are suitable for use as toner material as they possess good triboelectric and fusing properties.

Any suitable pigment material may be used in the process of the invention. A pigment generally should be capable of being dispersed in a monomer, be insoluble in the water used in the cladding and polymerization processes and give strong, clear, permanent colors when used as toner. Typical of such pigments are phthalocyanines, lithols and toluidene. Typical of phthalocyanine pigments are copper phthalocyanine, mono-chlor copper phthalocyanine, hexadecachlor copper phthalocyanine, metal-free phthalocyanine, mono-chlor metal-free phthalocyanine, and hexadecachlor metal-free phthalocyanines; anthraquinone vat pigments such as: vat yellow 6 GL CI 1127, quinone yellow 18-1, indanthrone CI 1106, pyranthrone CI 1096; brominated pyranthrones such as: dibromopyranthrone, vat brilliant orange RK, anthrimide brown CI 1151, dibenzanthrone green CI 1101, flavanthrone yellow CI 1118; thioindigo pigments such as: thioindigo red and pink FF; azo pigments such as: toluidine red CI 69 and hansa yellow; and metalized pigments such as: azo yellow (green gold) and permanent red. Carbon black has been found to be a preferred colorant as it is low in cost, may be completely cladded, and provides strong black images at relatively low loading of the colorant. Carbon black requires cladding as its surface contains active groups that are free radical traps and quinoid structures which inhibit polymerization. The carbon black may be of any of the known types such as channel black or furnace black. The furnace black is preferred as it is lower in cost. The amount of carbon black necessary in the toner typically is between about 1 and about 20 percent. A loading of between about 5 and about 10 percent in the toner has been found to be suitable for the process of the invention.

A reactive material which causes the cladding of the pigments to prevent their inhibition of or reaction with the monomer during its polymerization is used in the invention. Typical of such materials are water soluble monomers that precipitate onto carbon black or other pigments such as neutralized poly-acrylic acid and reactive silanes such as amine silicate-organosilane copolymers. Acrylonitrile monomer has been found to be a suitable water soluble monomer which will precipitate onto carbon. The reactive silanes of water emulsified or water soluble types, such as hydroxy functional silanes including di- and trimethoxysilanes, di- or triethoxy silanes and disilizanes, have been found to be suitable for the cladding process. Illustrative of members of the above groups are n-b-aminoethyl-aminopropyl trimethoxysilane, glycidoxy-propyltrimethoxysilane, mercaptopropyl(trimethoxysilane), 3-chloropropyltrimethoxysilane, and hexamethyl(disilazane). A preferred silane is triethoxy silane ($C_{18}$-$Si(C_2H_5O)_3$) marketed as "Siliclad" by the Clay Adams Division of Becton Dickinson and Company, which gives a good polymeric coating on carbon black that prevents the inhibition of the polymerization process by carbon black. The polymerization time of a system containing silane treated carbon black is about the same as the polymerization time of one not containing carbon black.

The cladding agent utilized is provided in any amount which provides a covering of the pigment sufficient to prevent the pigment inhibiting complete polymerization. Generally, the cladding agent is used in an amount that is the minimum which will give complete coverage as this keeps the expense and time of cladding low. Typically, an amount of cladding agent from about 0.05 to 10 percent by weight of the pigment may be utilized. A suitable range has been found to be 0.1 to 4 percent by weight of the pigment. A preferred range in the case of triethoxy silane is from about 1 percent to about 3 percent.

Any catalyst or initiator which is compatible with the particular monomer being used may be utilized in the process of the invention. Typical of initiators for polymerization are the peroxide and azo initiators. Among those found suitable for use in the process of the invention are azobis(2-methylpropionitrile) and lauryl peroxide which result in complete polymerization without leaving detrimental residual materials or requiring high temperatures or pressures. The initiator may be added to the monomer during dispersion of the carbon black or may be mixed in after carbon black dispersion.

If desired, a stabilization agent other than the monomer itself in the solution may be utilized in the instant invention. Such an agent aids in the formation of particles which will remain dispersed in the water during polymerization and not agglomerate. Any suitable stabilization agent may be used. Typical of such stabilizers are both non-ionic and ionic water soluble polymeric stabilizers such as methyl cellulose, ethyl cellulose, sodium salt of carboxyl methyl cellulose, polyacrylate acids and their salts, polyvinyl alcohol gelatins, starchs, gums, algimates, zein and casin. Suitable stabilization agents are polyacrylic acid, polymethacrylic acid, polyacrylamide and polyethylene oxide. Suitable agents for this invention are polyethylene oxide-polypropylene block copolymers and polyvinyl alcohol, which give good suspension at low concentration. The stabilizer is generally added in a ratio based on the amount of water. An amount of about 0.2 to about 5 percent by weight stabilizer to water is suitable. An amount of about 0.2 to about 1.5 percent is preferred to give good suspension at low cost and low impurity in the particles. An optimum amount for use in formation of toner polymers is about 0.75 to about 1 percent to give low materials cost and low agglomeration. The preferred polyvinyl alcohol contains from about 1 to about 20 mole percent of polyvinyl acetate groups. The optimum amount of polyvinyl acetate is about 16 mole percent to give good dispersion at low concentrartion. The molecular weight of suitable polyvinyl alcohols is between about 10,000 and about 125,000 number average molecular weight. A preferred polyvinyl alcohol is Monsanto 20–60 of about 90,000 weight average molecular weight. The preferred polyethylene oxide-polypropylene (PEO-PPO) block copolymers comprise about 40 to about 80 weight percent ethylene oxide. Suitable molecular weights of the (PEO-PPO) block copolymer are between about 3,000 and about 27,000 weight average molecular weight. A preferred range of molecular weight is between about 10,000 and 15,000 weight average to give good dispersion and low agglomeration.

The preferred stabilization agents of this invention are inorganic particles which are easy to use, give low agglomeration and do not interfere with polymerization. The preferred agents include tricalcium phosphate, talcum and barium sulfate to give a stable dispersion, easy removal of the agent and stable triboelectric properties.

The suspension of pigment containing monomer may be carried out in any suitable type of mixer which results in particles in stable suspension.

The reactor vessels suitable for suspension polymerization are known in the art. They generally comprise a strong, non-reactive container having a paddle or blade stirrer to agitate the suspension during the polymerization.

The particles formed by the bead polymerization process of the invention may be any size which can be economically formed in stable dispersion. The pigment containing monomer forms about 0.2 to about 40 percent of the total volume of the monomer and water mixture during polymerization. The particle size typically will be between about 200 and about 900 microns. A preferred range of particle size is about 200 microns to about 600 microns for effective grinding to toner of uniform size and ease of formation.

The apparatus to break down the beads resulting from suspension polymerization into toner size particles may be any attrition device capable of producing a narrow size range of particles of about 5 microns to about 30 microns size range. Typical of suitable apparatus are jetting mills, ball mills, and hammer mills to produce particles of the desired size without adding impurities or large amounts of fines. If necessary, the particles may be classified after attrition to obtain a narrow size range.

If desired, any suitable chain transfer agents or crosslinking agent or mixtures thereof may be used in the invention to modify the polymeric particle to produce particularly desired properties. Typical of crosslinking agents of the invention are aromatic divinyl compounds such as divinylbenzene, divinylnaphthalene or derivatives thereof; diethylenecarboxylate esters such as diethyleneglycol methacrylate, diethyleneglycol acrylate; any other divinyl compounds such as divinyl sulfide or divinyl sulfone compounds provided with three or more vinyl radicals; or mixtures of the foregoing compounds. Chain transfer agents act to control molecular weight by inhibiting chain growth. Typical of chain transfer agents of the invention are mercaptans such as laurylmercaptan, phenylmercaptan, butylmercaptan, dodceylmercaptan; or halogenated carbons such as carbon tetrachloride or carbon tetrabromide. Also, examples of materials which become effective when used in a much larger amount such as solvents for the vinyl monomer are substituted aromatic compounds such as toluene or isopropylbenzene; or substituted fatty acids such as trichloroacetic acid or tribromoacetic acid. Also, examples of materials which can be added as a monomer to be incorporated in the resulting polymer and simultaneously effect molecular weight control are ethylenic unsaturated monoolefins with radicals such as propylene or isobutylene; allyl compounds such as allyl benzene, allyl acetate or allylidene chloride.

Any suitable carrier may be used in the toner of the instant invention to form a developer. Suitable coated and uncoated carrier materials for cascade and magnetic brush development are well known in the art. The carrier particles may be electrically conductive, insulating, magnetic or nonmagnetic provided that the carrier particles acquire a charge having an opposite polarity to that of the toner particles when brought in close contact with the toner particles so that the toner particles adhere to and surround the carrier particles. When a positive reproduction of an electrostatic image is desired, the carrier particle is selected so that the toner particles acquire a charge having a polarity opposite to that of the electrostatic latent image. Alternatively, if a reversal reproduction of the electrostatic image is desired, the carriers are selected so that the toner particles acquire a charge having the same polarity as that of the electrostatic image. Thus, the materials for the carrier particles are selected in accordance with their triboelectric properties in respect to the electroscopic toner so that when mixed or brought into mutual contact, one component of the developer is charged positively if the other component is below the first component in the triboelectric series and negatively if the other component is above the first component in the triboelectric series. By proper selection of materials in accordance with their triboelectric effects, the polarities of their charge when mixed are such that the electroscopic toner particles adhere to and are coated on the surfaces of carrier particles and also adhere to that portion of the electrostatic image bearing surfaces having a greater attraction for the toner than do the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, steel, nickel, iron, ferrites, ferromagnetic materials, silicon dioxide and the like. The carriers may be employed with or without a coating. Many of the foregoing and typical carriers are described by L. E. Walkup in U.S. Pat. No. 2,618,551; L. E. Walkup et al in U.S. Pat. No. 2,638,416; E. N. Wise in U.S. Pat. No. 2,618,552; R. J. Hagenbach et al in U.S. Pat. No. 3,591,503 and U.S. Pat. No. 3,533,835; and B. J. Jacknow et al in U.S. Pat. No. 3,526,533. An ultimate coated carrier particle diameter between about 50 microns to about 1,000 microns is preferred because the carrier particles then possess sufficient density and inertia to avoid adherence to the electrostatic images during the cascade development process. Adherence to carrier beads to xerographic drum surfaces is undesirable because of the formation of deep scratches on the surface during the image transfer and drum cleaning steps, particularly where cleaning is accomplished by a web cleaner such as the web disclosed by W. P. Graff, Jr. et al in U.S. Pat. No. 3,186,838. Also, print deletion occurs when carrier beads adhere to electrostatographic imaging surfaces.

PREFERRED EMBODIMENTS

The following examples further define, describe, and compare methods of preparing developers of the instant invention and of utilizing them in electrophotographic applications. Parts and percentages are by weight unless otherwise indicated.

EXAMPLE I 44 grams of Raven 420 is treated to clad by stirring in a beaker containing a 2 percent solution of triethoxysilane (Siliclad) in water. The treated carbon black is then recovered from the water. To a Waring Blender equipped with a rotor stator (Polytron head) is added 339 grams of inhibitor-free styrene, 44 grams of the above-treated Raven 420 and about 6.8 l grams of lauroyl peroxide. The temperature of the mixture is raised to 70° C. and held there while mixing under high shear with the polytron head for 10 minutes. At the end of this time, 245 grams of n-butyl methacrylate (inhibitor-free) is added. To 150 grams of the above mixture is added 9.66 grams of lauroyl peroxide. This is sized in a 1 liter flask stirred with a paddle blade at about 75 r.p.m. and containing about 700 milliliters of deionized water with about 9 grams of suspended tricalcium phosphate powder. The stirring speed is adjusted to 200 r.p.m. for 45 seconds and then to the approximate 80 r.p.m. for 7 hours to complete polymerization. Nitric acid is added to convert the tricalcium phosphate to a water soluble salt. The beads are recovered by filtering, followed by washing and drying. The beads are jetted to produce a xerographic toner having a particle size range of about 8 to about 25 microns. This toner is found to have stable triboelectric properties and produces excellent copies in a Model D processor.

EXAMPLE II 150 grams of the monomer and carbon black mixture of Example I is sized into 600 ml of a 0.2 percent Covol 9720 polyvinyl alcohol solution at a paddle blade speed of 200 r.p.m. for 1 minute. The speed of the stirrer is then turned down to 80 r.p.m. and suspended pigmented droplets polymerized at 70° C. for 7 hours. The beads are recovered by filtering and washing several times and air dried. The beads are uniformly pigmented and are jetted to produce a xerographic toner which gives good images when utilized in a Model D processor.

EXAMPLE III

A monomer mixture of 95 percent styrene and 5 percent n-butyl methacrylate with 7 percent treated Raven 420 dispersed as in Example I, and 7 percent lauroyl peroxide based on the weight of monomer is added. 150 grams of this mixture is sized into 600 ml of deionized water containing 3 grams of talcum powder at a speed of 150 r.p.m. for 2 minutes. The speed is then turned down to 80 r.p.m. to polymerize the beads at 70° C. for 7 hours. After polymerization is complete, the beads are recovered as in previous Examples. The beads are uniformly pigmented and are jetted to produce a xerographic toner of about 8 to 25 microns. This toner when utilized in a Model D processor produces clear sharp images.

EXAMPLE IV

The process of Example I is repeated substituting monomer which is a mixture of 65 parts styrene monomer and 35 parts n-butyl methacrylate. The toner is found to have suitable triboelectric and fusing properties.

EXAMPLE V

As a control, the process of Example I is repeated except that the carbon black is not treated with Siliclad. The particles when formed into toner did not exhibit good xerographic properties and were incompletely polymerized.

EXAMPLE VI

The process of Example I is repeated except that Dow Corning reactive silane DC-Z-6020 is substituted for the Siliclad. This is found to produce toner which has good xerographic properties.

EXAMPLE VII

The process of Example I is performed utilizing acrylonitrile monomer in an amount of about 1.7 percent with water as the cladding agent. The toner produced is of good quality.

EXAMPLE VIII

The process of Example I is repeated substituting as the stabilization agent Monsanto 20–60 a polyvinyl alcohol of about 90,000 weight average molecular weight and about 16 mole percent polyvinyl acetate groups. The toner produced is of good quality.

EXAMPLE IX

The process of Example I is repeated except a 70/30 polyethylene oxide - polypropylene block copolymer of about 10,000 to 15,000 number weight MW (Pluronic F-127) is substituted for polyvinyl alcohol as the stabilization agent. The toner produced is of good quality.

EXAMPLE X

The process of Example I is repeated except a 40/60 polyethylene oxide - polypropylene block copolymer of about 10,000 to 15,000 number average molecular weight (Tetronic 1504) is substituted for the tricalcium phosphate stabilizer. The toner gives good performance in a Model D copier.

Although specific materials and conditions were set forth in the above exemplary processes in the formation of the toner of the invention, these are merely intended as illustrations of the present invention. Various other substituents and processes such as those listed above, may be substituted for those in the Examples with similar results. In addition to the steps used to prepare the toner of the present invention, other steps or modifications may be used if desired. In addition, other materials may be incorporated into the toner of the invention which will enhance, synergize or otherwise desirably effect the properties of these materials for their present use. For example, additives to increase resistance to moisture absorption or to effect triboelectric properties, could be added to the surface of the particles.

Other modifications of the present invention will occur to those skilled in the art upon a reading of the present disclosure. For instance, magnetic pigments or additives could be used in the process if it was desired that magnetic toner be produced. Further, if toner for use in developing processes other than magnetic or cascade were desired, the particle size could be attrited to be smaller such as 1 to 5 microns for use in powder cloud development processes.

What is claimed is:

1. A method of toner formation comprising agitating an aqueous mixture of a pigment and a reactive material to form a coating on the pigment to clad the pigment, wherein said pigment is insoluble in water and capable of being dispersed in a monomer, dispersion of the cladded pigment in monomer, wherein said monomer is capable of being polymerized into a polymeric material by dispersion polymerization and said polymeric material has a melting point within the range suitable for use as a toner, agitation of the monomer containing pigment in water to form droplets in suspension, said droplets having a size of from about 200 to about 600 microns, agitation of said monomer during polymerization to form particles having a size of from 200 to 600 microns, washing and drying the particles and reducing the particle size thereof to 5 to 30 microns by attrition to form toner.

2. The method of claim 1 wherein said pigment is carbon black.

3. The method of claim 1 wherein said monomer comprises styrene.

4. The method of claim 1 wherein said agitation during polymerization is carried out for longer than about 3 hours.

5. The method of claim 1 wherein said pigment containing monomer forms about 0.2 to about 40 percent of the total volume of the monomer and water mixture.

6. The method of claim 1 wherein an initiator is present during pigment dispersion in the monomer.

7. The method of claim 6 wherein said initiator is lauryl peroxide.

8. The method of claim 6 wherein said cladded pigment and said initiator are dispersed in said monomer by high shear mixing prior to said agitation to form the suspension.

9. The method of claim 1 wherein an effective amount of stabilizer is present during dispersion.

10. The method of claim 9 wherein said stabilizer is selected from the group consisting of talcum, tricalcium phosphate and barium sulfate.

11. The method of claim 10 wherein said stabilizer is removed after polymerization.

12. The method of claim 9 wherein said stabilizer is present in about 0.75 to about 1 percent by weight of the water.

13. The method of claim 9 wherein said stabilizer comprises a material selected from the group consisting of polyethylene oxide, polyacrylic acid, polymethacrylic acid and polyacrylamide and polyvinyl alcohol.

14. The method of claim 1 wherein said attrition is by jetting.

15. The method of claim 1 wherein said monomer additionally has dispersed therein a material selected from the group consisting of crosslinking agents, chain transfer agents and mixtures thereof.

16. The method of claim 1 wherein the cladding of the pigment comprises suspension of the pigment in a solution of reactive monomer and water.

17. The method of claim 16 wherein said reactive monomer is selected from the group consisting of dimethoxysilanes, trimethoxysilanes, diethoxy silanes, triethoxy silanes and disilizanes.

18. The method of claim 16 wherein said reactive monomer comprises a reactive silane.

19. The method of claim 16 wherein said reactive monomer is triethoxy silane.

20. The method of claim 19 wherein said silane comprises between about 1 and about 3 percent of the water in said solution.

21. The method of claim 16 wherein said reactive silane comprises between about 0.1 and 4 weight percent of the water in said solution.

* * * * *